US007850345B2

(12) United States Patent
Holder et al.

(10) Patent No.: US 7,850,345 B2
(45) Date of Patent: Dec. 14, 2010

(54) OPTIC FOR LEDS AND OTHER LIGHT SOURCES

(75) Inventors: Ronald G. Holder, Laguna Niguel, CA (US); Greg Rhoads, Irvine, CA (US)

(73) Assignee: Illumination Management Solutions Inc., Irvine, CA (US)

( * ) Notice: Subject to any disclaimer, the term of this patent is extended or adjusted under 35 U.S.C. 154(b) by 463 days.

(21) Appl. No.: 12/063,234

(22) PCT Filed: Aug. 16, 2006

(86) PCT No.: PCT/US2006/032054

§ 371 (c)(1),
(2), (4) Date: Feb. 7, 2008

(87) PCT Pub. No.: WO2007/022314

PCT Pub. Date: Feb. 22, 2007

(65) Prior Publication Data

US 2008/0192477 A1 Aug. 14, 2008

Related U.S. Application Data

(60) Provisional application No. 60/709,394, filed on Aug. 17, 2005.

(51) Int. Cl.
*F21V 7/00* (2006.01)

(52) U.S. Cl. ..... 362/347; 362/294; 362/341; 362/346

(58) Field of Classification Search ..... 362/294, 362/341, 346, 347
See application file for complete search history.

(56) References Cited

U.S. PATENT DOCUMENTS

| | | | |
|---|---|---|---|
| 4,211,955 | A | 7/1980 | Ray |
| 4,286,311 | A | 8/1981 | Maglica |
| 4,398,238 | A | 8/1983 | Nelson |
| 4,570,208 | A | 2/1986 | Sassmannshausen |
| 4,577,263 | A | 3/1986 | Maglica |

(Continued)

FOREIGN PATENT DOCUMENTS

| | | |
|---|---|---|
| DE | 20310418 | 9/2003 |

(Continued)

OTHER PUBLICATIONS

International Searching Authority, The International Search Report and The Written Opinion for PCT/US06/32054 dated Apr. 26, 2007, 14 pages.

(Continued)

*Primary Examiner*—Sandra L O Shea
*Assistant Examiner*—Mary Zettl
(74) *Attorney, Agent, or Firm*—King & Spalding LLP

(57) ABSTRACT

An LED lighting device comprises an LED light source; a thermal management element coupled to the LED light source to manage heat generated by the LED light source; a primary reflector with at least one reflective surface oriented to collect light from the LED light source and direct collected light into a first reflected beam; at least one central inclined reflector surface disposed to receive light from the LED light source; and at least one corresponding angled mirror surface disposed to collect light from the central inclined reflector surface and to direct the collected light into a second reflected beam (see FIG. 1).

21 Claims, 3 Drawing Sheets

U.S. PATENT DOCUMENTS

| | | | | |
|---|---|---|---|---|
| 4,727,289 | A | 2/1988 | Uechida | |
| 4,729,076 | A | 3/1988 | Masami et al. | |
| 4,733,337 | A | 3/1988 | Bieberstein | |
| 4,842,396 | A | 6/1989 | Minoura et al. | |
| 5,528,474 | A | 6/1996 | Roney et al. | |
| 5,634,711 | A | 6/1997 | Kennedy et al. | |
| 5,857,767 | A | 1/1999 | Hochstein | |
| 5,889,567 | A | 3/1999 | Swanson et al. | |
| 5,924,785 | A | 7/1999 | Zhang et al. | |
| 5,926,411 | A | 7/1999 | Russell | |
| 6,045,240 | A | 4/2000 | Hochstein | |
| 6,168,288 | B1 | 1/2001 | St. Claire | |
| 6,371,636 | B1 | 4/2002 | Wesson | |
| 6,485,160 | B1 | 11/2002 | Sommers et al. | |
| 6,502,952 | B1 | 1/2003 | Hartley | |
| 6,685,336 | B1 | 2/2004 | Neiser | |
| 6,765,556 | B2 | 7/2004 | Kandogan et al. | |
| 6,796,698 | B2 | 9/2004 | Sommers et al. | |
| 6,871,993 | B2 * | 3/2005 | Hecht | 362/555 |
| 7,040,782 | B2 * | 5/2006 | Mayer | 362/350 |
| 2002/0021292 | A1 | 2/2002 | Sakashita | |
| 2002/0085374 | A1 * | 7/2002 | Anderson | 362/147 |
| 2002/0141197 | A1 | 10/2002 | Petroski | |
| 2002/0191398 | A1 * | 12/2002 | Keller | 362/247 |
| 2003/0011538 | A1 | 1/2003 | Lys et al. | |
| 2003/0107885 | A1 | 6/2003 | Galli | |
| 2003/0184999 | A1 | 10/2003 | Neiser | |
| 2004/0037088 | A1 * | 2/2004 | English et al. | 362/545 |
| 2004/0114366 | A1 * | 6/2004 | Smith et al. | 362/247 |
| 2004/0155565 | A1 | 8/2004 | Holder et al. | |
| 2005/0007768 | A1 | 1/2005 | Holder et al. | |

FOREIGN PATENT DOCUMENTS

| | | |
|---|---|---|
| JP | 3072987 | 7/2000 |
| JP | 2000357567 | 12/2000 |
| JP | 2003178602 | 6/2003 |
| WO | WO02/097884 | 12/2002 |
| WO | WO03/016778 | 2/2003 |

OTHER PUBLICATIONS

International Searching Authority, The International Search Report and The Written Opinion for PCT/US06/32054 dated Apr. 26, 2007, 14 pages.

International Searching Authority, The International Search Report and The Written Opinion for PCT/US04/18501 dated Jun. 7, 2005, 7 pages.

* cited by examiner

OPTIC FOR LEDS AND OTHER LIGHT SOURCES

RELATED APPLICATIONS

The present application is related to U.S. Provisional Patent Application Ser. No. 60/709,394, filed on Aug. 17, 2005, pursuant to 35 USC 119 and which is incorporated herein by reference.

BACKGROUND OF THE INVENTION

1. Field of the Invention

The invention relates to the field of LED light sources and in particular to sources which have an LED directly rearwardly into a reflector.

2. Description of the Prior Art

In recent years several patents have been issued and many products have entered the market utilizing an LED emitter with its roughly hemispherical radiation pattern facing 'backwards' into a concave reflector and the reflected energy returns back past the LED.

One example is shown by Zhang U.S. Pat. No. 5,924,785 that shows an LED suspended over a concave reflector by its leads. Another example is shown by Holder and Rhoads, U.S. Patent Application 20040155565, which is incorporated herein by reference. Holder and Rhoads shows a module with an LED suspended over a reflector on a heat sink.

Both of these examples have the same drawback in that the energy from the prime central rays of the LED is blocked from becoming part of the total beam of energy of the device by the LED and support structure itself. As the device gets smaller in relationship to the LED and structure, the inefficiencies get larger.

What is needed is an efficient means to extract the blocked energy from the central portion of the LED energy and merge it with the energy of the primary beam.

BRIEF SUMMARY OF THE INVENTION

A preferred embodiment of the invention includes: (1) a light emitting diode (LED) light source or other light source; (2) a heat sink or other thermal management system; (3) a primary concave reflector with at least one reflective surface; (4) at least one central inclined reflector surface; and (5) an angled mirror surface(s) set near the upper peripheral edge of the primary reflector to accept and reflect the energy from the inclined reflector surface. While the illustrated embodiments of the invention are disclosed with LEDs as the light source, it is to be expressly understood that any other known or later devised source of light could be equivalently substituted and is expressly contemplated as being within the scope of the invention.

In the preferred embodiment the primary reflector comprises a parabolic reflector as defined by a surface of rotation facing the rearwardly directed LED. The central inclined reflector surface comprises a similar parabolic surface of rotation. It is to be expressly understood that any other type of reflector now known or later devised could be substituted for the primary reflector and central inclined reflector surface according to the design goals.

The energy from the peripheral forward solid angle of the LED, which is directed rearwardly into the primary reflector, is reflected by the primary reflector into a reflected beam which is reflected forwardly in direction of the LED and approximately along the centerline or optical axis of the primary reflector. An approximate cone or central solid angle of energy from the LED that would have been blocked by the LED and its supporting structure when reflected, as is the case for prior art devices, is included in the central forward solid angle of the beam generated by a device made according to the invention.

The energy in the central forward solid angle of light radiated from the LED of the invention which impinges on the central inclined reflector surface is collected by the central inclined reflector surface and reflected to the angled mirror surface(s). The angled mirror surface is oriented to reflect the energy directed to it into a beam that is approximately parallel or combined with the energy reflected from the primary reflector to form a composite forward beam.

In the illustrated embodiment, the central inclined reflector surface is defined as a parabolic surface of rotation about an optical axis or centerline with a cross-section of parabola. The focus of the reflector surface is positioned at or near the center of the light source, an LED emitter. The surface is inclined from the optical axis of the primary reflector about its focus in such a way as to reflect the energy from it surface(s) toward a mirrored surface defined at an azimuthal angular position on the peripheral surface of primary reflector. A light ray from the emitter's central forward solid angle is reflected from surface as a first ray and is reflected again by inclined mirrored surface as a second ray. The bisector of the angle between the two rays defines the normal for inclined planar mirror surface at the point of impingement of ray onto the surface.

Another preferred embodiment of the invention may utilize an ellipse as the primary reflector. The ellipse is characterized by a specified first and second focus. The light source or LED is placed at or near the first focus and the primary reflector is a rotational surface with the ellipse as its longitudinal cross section. In a device of this embodiment of the invention, the surfaces and angles of the inclined central reflector surface and the inclined mirror surface are defined by the optical axis or normal of the angled mirrored surface being the bisector of the angle between a first ray reflected from the central inclined reflected surface and a second ray reflected from the angled mirror surface line that passes through the point of second focus of the primary reflector.

A preferred use for this embodiment is to focus energy onto the end of a fiber in a fiber optic system. The demarcation between the forward solid angle of energy from the light source and the peripheral forward solid angle in this embodiment is best determined at the point on the primary reflector where the reflected energy is occluded from the target by the source or its support means. All the energy from the point so determined to the centerline is best collected by the center inclined reflector surface(s). However, it must be clearly understood that the elliptical embodiment need not be combined with a fiber optic and can be used in many other applications.

It is understood that many surface types could be substituted in a device of the invention. The surfaces could be inclined surfaces of almost any cross-section including conics and aspheric as well as nonuniform surfaces. The surfaces could also not be surfaces of rotation at all but surfaces of three dimensional points defined by any method. The mirrored surface could also be non-planer if desired. The surfaces could also be textured or smooth. The number of central inclined reflector surfaces could vary based on design criteria, but at least one is required. The number of mirrored surfaces would normally be the same as the number of central inclined reflector surfaces.

The invention applies to the general field of optics and a significant improvement to the efficiency of a particular type thereof. The invention primarily focuses on an area of illumination that incorporates the light emitting diode (LED) as its source, but is not limited to use of an LED. The illustrated embodiment of the invention has realized 10-20% improvement of that realized in copending patent application Ser. No. 10/866,357, filed Jun. 10, 2004, directed to "An Improved Led Flashlight", assigned to the same assignee of the present invention and incorporated herein by reference.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

Figure 1:
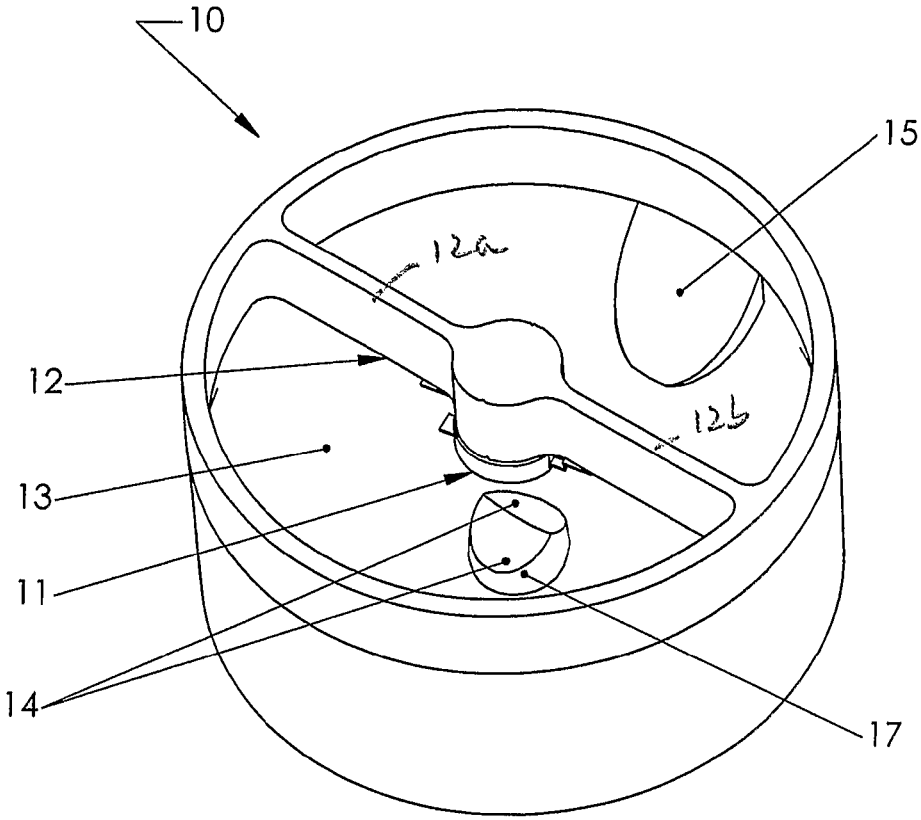
FIG. 1 is a perspective three dimensional view of a preferred embodiment of a device of the invention, which view shows the primary reflector and an LED mounted on a heat sink over the reflector, central inclined surfaces, in this case two, which reflect energy toward the mirror surfaces (one not shown).

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Thus, the illustrated embodiments of the invention are directed to an apparatus comprising an LED light source, a thermal management element coupled to the LED light source to manage heat generated by the LED light source; a primary reflector with at least one reflective surface oriented to collect light from the LED light source and direct collected light into a first reflected beam; at least one central inclined reflector surface disposed to receive light from the LED light source; and at least one corresponding angled mirror surface disposed to collect light from the central inclined reflector surface and to direct the collected light into a second reflected beam. The first and second reflected beams are combined into a composite beam. In one embodiment the first and second reflected beams are approximately parallel.

In the illustrated embodiments the primary reflector has an upper peripheral edge and where the angled mirror surface is disposed at or near the upper peripheral edge of the primary reflector to collect and redirect the energy from the central inclined reflector surface.

The LED is rearwardly directed and in one embodiment the primary reflector comprises a parabolic reflector as defined by a surface of rotation facing the rearwardly directed LED. The central inclined reflector surface comprises a parabolic surface of rotation.

The LED light source radiates energy in a peripheral forward solid angle, which energy is directed rearwardly into the primary reflector, is reflected by the primary reflector into a reflected beam, which is reflected forwardly in direction of the LED light source approximately along the centerline or optical axis of the primary reflector. The LED light source radiates energy in a central solid angle, which energy would have been blocked by the LED light source when reflected, but for being included in a central forward solid angle of the composite beam. The energy in the central forward solid angle of light radiated from the LED light source, which energy impinges on the central inclined reflector surface, is collected by the central inclined reflector surface and reflected to the angled mirror surface. The angled mirror surface is oriented to reflect the energy directed to it into a beam that is approximately parallel or combined with the energy reflected from the primary reflector to form the composite beam.

In one embodiment the angled mirror surface is oriented such that its optical axis is a bisector of the angle between a second reflected light ray reflected from the angled mirror surface and a first reflected ray reflected from the central inclined reflector surface to the angled mirror surface. The first reflected ray is parallel to a centerline of the surface of rotation that defines the central inclined reflector surface.

In the preferred embodiment there are at least two inclined central reflector surfaces and at least two corresponding angled mirror surfaces. The primary reflector has a first elliptical surface characterized by a first and second focus. Each inclined central reflector surface has a second elliptical surface. The LED light source is disposed at or near the first focus of the first elliptical surface of the primary reflector. The shape and angular orientation of each of the inclined central reflector surfaces is defined by the second elliptical surface. Each of the angled mirror surfaces is defined by a normal to the angled mirrored surface which normal is a bisector of the angle between a first ray reflected from the corresponding central inclined reflector surface to the corresponding angled mirror surface and a second ray reflected from the angled mirror surface to the second focus of the first elliptical surface of the primary reflector. In a further embodiment the second focus is defined at or near an end of an optic fiber.

In another one of the preferred embodiments where there are at least two inclined central reflector surfaces and at least two corresponding angled mirror surfaces, the primary reflector has a first parabolic surface characterized by a first focus. Each inclined central reflector surface has a second parabolic surface. The LED light source is disposed at or near the first focus of the first parabolic surface of the primary reflector. The shape and angular orientation of each of the inclined central reflector surfaces is defined by the second parabolic surface. Each of the angled mirror surfaces is defined by a normal to the angled mirrored surface which normal is a bisector of the angle between a first ray reflected from the corresponding central inclined reflector surface to the corresponding angled mirror surface and a second ray reflected from the angled mirror surface in a predetermined forward direction.

A demarcation point is defined between the forward solid angle of energy from the LED light source and the peripheral forward solid angle of the LED light source at that point on the primary reflector where the reflected energy is blocked by the LED light source. Substantially all the energy from the demarcation point to the optical axis of the LED light source is collected by the center inclined reflector surface.

The illustrated embodiments utilize the claimed apparatus in a flashlight, head torch, automotive headlight, bicycle light, aircraft lighting, marine lighting, theater and stage lighting, general area lighting, fiber optic system, reading light, medical lighting, dental lighting or overhead task light.

The invention further comprises a method for generating light and redirecting it as set forth in any one of the above embodiments.

Turn now and consider the illustrated embodiments as depicted in the figures. FIG. 1 shows a perspective view of device 10 of the invention with an LED 11 suspended on a heat sink 12 over a primary reflector 13. Heat sink 12 comprises a thermally conductor spider arm 12*a* and 12*b* diametrically extending across the aperture of device 10, spanning reflector 13, positioning LED 11 at a predetermined height and centering LED 11 over reflector 13. Heat sink 12 in the illustrated embodiment is composed of aluminum, but any heat conducting material may be equivalently employed. The central portion of the primary reflector 13 is interrupted by a pedestal 17 incorporating two opposing, inclined, reflective, generally curved surfaces 14. Also shown is the inclined angled mirrored surface 15 defined as a facet on reflector 13 as best seen in the cross sectional view of FIG. 2. In the illustrated embodiment reflector 13 has an optical axis of symmetry defined by its primary reflective surface portion, i.e. that portion exclusive of surfaces 14 and 15, which axis is oriented in a direction perpendicular to the planar aperture of device 10. Hence, LED 11 is oriented by heat sink 12 to lie on the optical axis of reflector 13 and to be directly pointed into reflector 13 so that its illumination pattern, which is also generally radially symmetrical is aligned with the generally radially symmetrical primary surface of reflector 13.

However, it is to be understood that the optical axis of reflector 13 in other embodiments could be tilted at an angle with respect to the planar aperture of device 10 and similarly LED 11 mounted on heat sink 12 to be both tilted into the inclined reflector 13 and offset from the center of heat sink 12 in order to remain lying the on tilted optical axis of reflector 13.

Figure 2:
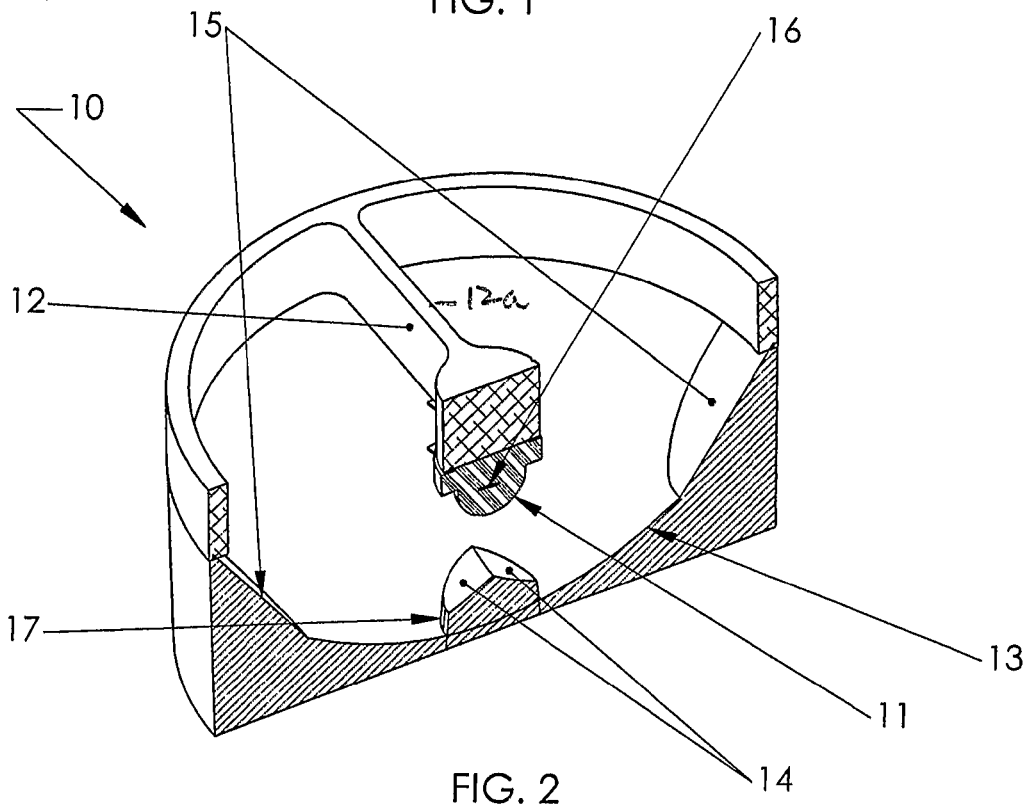
FIG. 2 is a cross-sectional perspective view which illustrates the features of the preferred embodiment of the invention of FIG. 1.

FIG. 2 is a cut-away perspective view of the device 10 of FIG. 1 showing the LED emitter 16 within LED 11 positioned over the central inclined reflector surfaces 14, which form the top of pedestal 17 and the primary reflector 13. LED 11 is illustrated as including a conventional LED package with a hemispherical lens integrally molded over emitter 16. The illumination pattern from such a conventional LED 11 is usually Lambertian.

However, it is to be expressly understood that other LED packaging could be employed as part of LED 11, such as providing integrally formed or separately attached lenses disposed on the package of FIG. 2 to provide specially shaped beams or illumination patterns from LED 11. In such cases the shape of reflector 13 and surfaces 14 and 15 may also be altered according to conventional optical design principles to obtain a predetermined illumination pattern from device 10.

Figure 3:
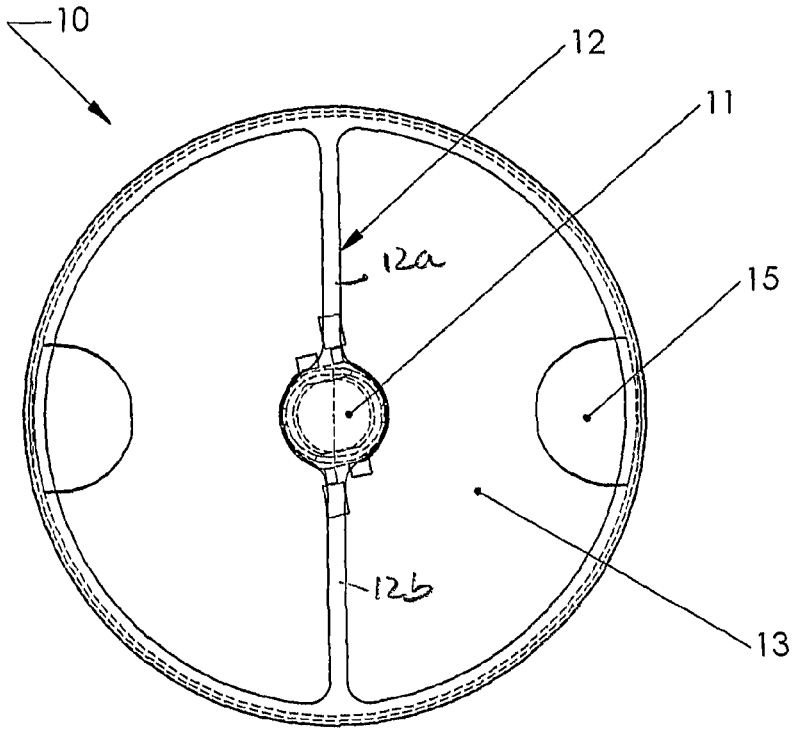
FIG. 3 is a planer top view of a device of the invention of FIGS. 1 and 2.

FIG. 3 is a top plan view of the device 10 of FIGS. 1 and 2 showing the planar relationships of the primary reflector 13, heat sink 12, LED 11, and angled mirrored surfaces 14 and 15. Here is it illustrated that the spider arms 12*a* and 12*b* of heat sink 12 are thermally coupled at their radial ends to the cylindrical body of device 10, which in turn in any installation may be further thermally coupled to fixtures, plates, arrays or bars of Which device 10 is a component. Further, the spider arms 12*a* and 12*b* of heat sink 12 also provide a means for electrical coupling to LED 11 or for carrying conductors or wires for electrical connection to LED 11 from a conventional drive circuit and power source (not shown) included at another location in device 10 or in the fixtures, plates, arrays or bars on which device 10 is mounted. In the illustrated embodiment conductive strips extend along and are electrically insulated from the bottom surface of arms 12*a* and 12*b* and are connected to tabs or terminals 50 extending from the packaging of LED 11. The details of electrical connection will, of course, depend on the packaging design of LED 11, which may vary depending on manufacturing source.

Figure 4:
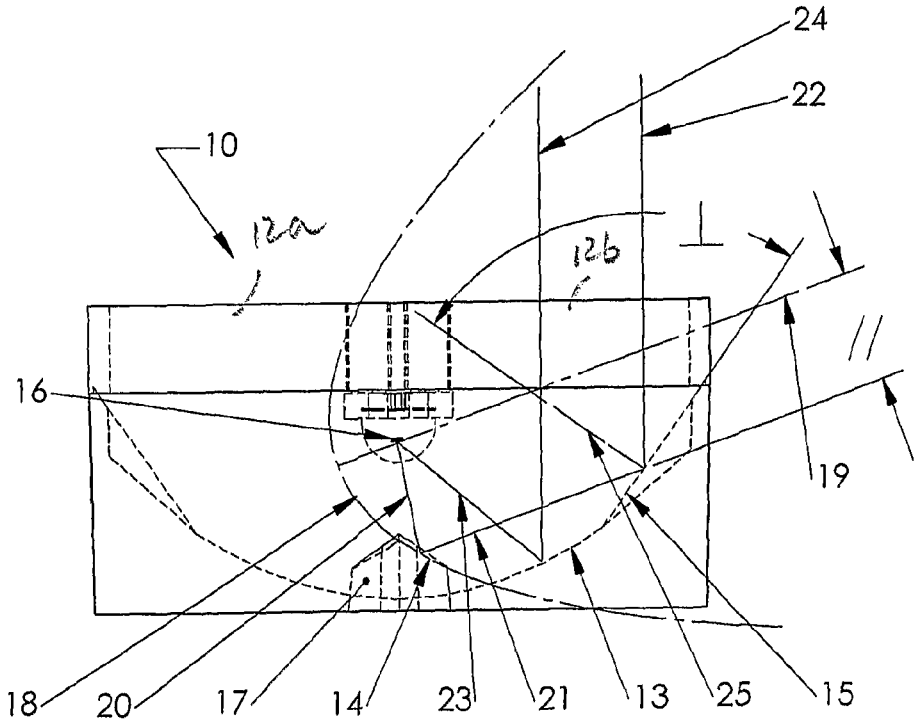
FIG. 4 is a side cross-sectional view of the device shown in FIGS. 1-3. This drawing shows the geometry related to the central inclined reflector surface and the inclined mirrored surface of a preferred embodiment of the invention.

FIG. 4 is a detailed cross-sectional view of the device 10 of FIGS. 1-3 showing the geometry which used to generate the surfaces and angles of the central inclined reflector surfaces 14 and the inclined mirror surfaces 15. In the embodiment shown, the central inclined reflector surfaces 14 are defined as a portion of a parabolic surface of rotation defined about an optical axis or centerline 19 with a parabolic cross-section 18 as shown in dashed line in FIG. 4. The focus of each of the reflector surfaces 14 is positioned at or near the center of the light source, which is an LED emitter 16 in this embodiment. The optical axis 19 of the parabolic surface 14 about its focus is inclined from the vertical optical axis of the primary reflector 13 in such a way as to reflect the energy from surface(s) 14 toward a corresponding opposing mirrored surface 15 defined at an azimuthal angular position on the peripheral surface of primary reflector 13. As illustrated by geometric ray tracing, a light ray 20 from the emitter's central forward solid angle is reflected from surface 14 as ray 21 and is reflected again into a forward beam directed out of the aperture of device 10 by inclined mirrored surface 15 as ray 22. In this embodiment the perpendicular bisector 25 of the angle between rays 21 and 22 defines the normal for inclined planar mirror surface 15 at the point of impingement of ray 21 and reflection of ray 22. Ray 23 from the peripheral forward solid angle of energy radiated from the LED light source 16 is reflected from the surface of primary reflector 13 as ray 24. In the illustrated embodiment ray 22 and ray 24 are substantially parallel to each other and the centerline or optical axis of the device 10. Generally, if rays 22 and 24 are not parallel or approximately parallel, they at least combine to form a composite beam from device 10.

Figure 5:
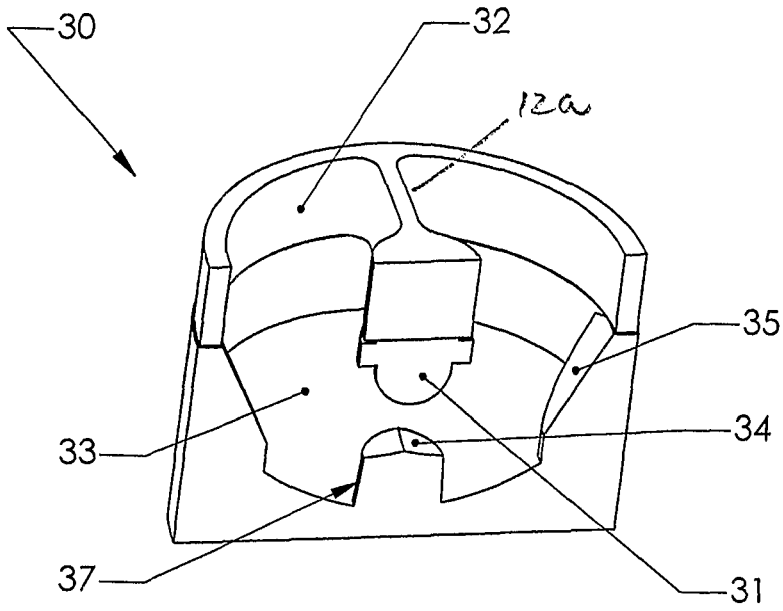
FIG. 5 is cross sectional perspective view of a second embodiment of the invention utilizing an elliptical primary reflector and an elliptical inclined center reflector surface.

FIG. 5 is a perspective three dimensional cut-away side cross sectional view of a second embodiment, namely a device 30 where the primary surface 33 and inclined central reflector surfaces 14 have elliptical cross section instead of a parabolic cross section as was the case with the embodiment of FIGS. 1-4. As in the first embodiment LED 31 is situated over the primary reflector 33 and the central inclined reflector surfaces 34 by means of heat sink 12. Mirror surfaces 35 have an analogous optical relationship to central inclined reflector surfaces 34 as surfaces 14 and 15 have in the embodiment of FIGS. 1-4.

Figure 6:
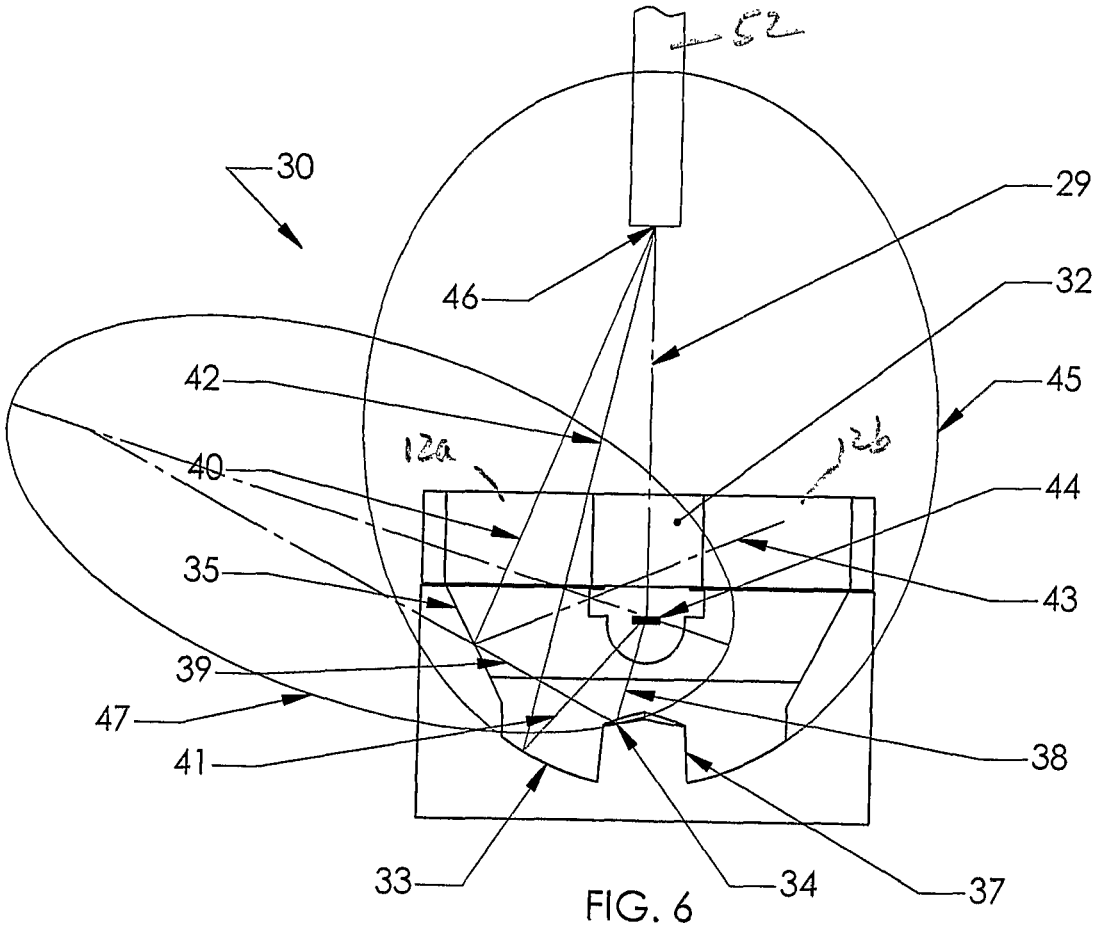
FIG. 6 is a cross-sectional view of the device of FIG. 5, which shows the geometry related to the rotation of the center inclined reflector surface and a inclined mirror.

FIG. 6 is a two dimensional side cross-sectional view of the device 30 of FIG. 5. The LED emitter 44 is situated at or near the first focus of primary ellipse 45, which defines the surface of the primary reflector 33. The end 46 of an optical fiber 52 is situated at the second focus of ellipse 45. Ray 41 represents the set of rays that impinge on the primary reflector 33 and are reflected as beam ray 42 to fiber end 46. Ray 38 represents the set of rays that comprise the forward solid angle of energy from LED emitter 44 and are reflected from surfaces 34 toward corresponding mirror surfaces 35 and again reflected as beam ray 40 to fiber end 46. Surface normal 43 of surface 35 is the perpendicular bisector of the angle between ray 39 and ray 40 at the point of impingement on surface 35.

Ray 39 represents a line defined between a point on the surface of rotation of the central inclined reflector surface 34 and the second focus of a second ellipse 47 used for the cross-section of inclined reflector surface 34. The ellipse 47 of the central inclined reflector surface 34 and the ellipse 45 of the primary reflector 33 are not necessarily equal or identical. In a preferred embodiment of the device 30, the point of second focus for the central inclined reflector surface 34 when reflected by mirror surface 35 is at the same location as the second focus of the ellipse 45 defining the primary reflector 33. However, it is to be expressly understood that where desired separate focal points could be determined for the two sets of rays.

While the figures show the inclined mirror surface 15 as interrupting the primary reflector 13, the inclined mirror surface 15 can be defined as being outside the perimeter of the primary reflector 13 as well. Again it must be expressly understood that the embodiment of the invention shown in FIGS. 5 and 6 using an elliptical reflector need not be combined with an optical fiber 52 and may be generally employed in any application.

It can now be readily appreciated that the invention may be used in a wide variety of applications including, but not limited to, flashlights, head torches, automotive headlights, bicycle lights, aircraft lighting, marine lighting, theater and stage lighting, general area lighting, fiber optic systems, reading lights of any kind, medical lighting, dental lighting and overhead task lights to mention only a few.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. An apparatus comprising:

an LED light source;

a thermal management element coupled to the LED light source to manage heat generated by the LED light source;

a primary reflector with at least one reflective surface oriented to collect light from the LED light source and direct collected light into a first reflected beam;

at least one central inclined reflector surface disposed to receive light from the LED light source;

at least one corresponding angled mirror surface disposed to collect light from the central inclined reflector surface and to direct the collected light into a second reflected beam, and at least two inclined central reflector surfaces and at least two corresponding angled mirror surfaces, where the primary reflector has a first elliptical surface characterized by a first and second focus, where each inclined central reflector surface has a second surface, and where the LED light source is disposed at or near the first focus of the first elliptical surface of the primary reflector, where the shape and angular orientation of each of the inclined central reflector surfaces is defined by the second elliptical surface, and where each of the angled mirror surfaces is defined by a normal to the angled mirrored surface which normal is a bisector of the between a first ray reflected from the corresponding central inclined reflector surface to the corresponding angled mirror surface and a second ray reflected from the angled mirror surface to the second focus of the first elliptical surface of the primary reflector.

2. The apparatus of claim 1 where the first and second reflected beams are combined into a composite beam.

3. The apparatus of claim 2 where the first and second reflected beams are approximately parallel.

4. The apparatus of claim 2 where the LED light source radiates energy in a central solid angle, which energy would have been blocked by the LED light source when reflected, but for being included in a central forward solid angle of the composite beam.

5. The apparatus of claim 4 where the energy in the central forward solid angle of light radiated from the LED light source, which energy impinges on the central inclined reflector surface, is collected by the central inclined reflector surface and reflected to the angled mirror surface.

6. The apparatus of claim 5 where the angled mirror surface is oriented to reflect the energy directed to it into a beam that is approximately parallel or combined with the energy reflected from the primary reflector to form the composite beam.

7. The apparatus of claim 1 where the primary reflector has an upper peripheral edge and where the angled mirror surface is disposed at or near the upper peripheral edge of the primary reflector to collect and redirect the energy from the central inclined reflector surface.

8. The apparatus of claim 1 where the LED light source radiates energy in a peripheral forward solid angle, which energy is directed rearwardly into the primary reflector, is reflected by the primary reflector into a reflected beam, which is reflected forwardly in direction of the LED light source approximately along the centerline or optical axis of the primary reflector.

9. The apparatus of claim 1 where the angled mirror surface has an optical axis and where the angled mirror surface is oriented such that its optical axis is a bisector of the angle between a second reflected light ray reflected from the angled mirror surface and a first reflected ray reflected from the central inclined reflector surface to the angled mirror surface, which first reflected ray is parallel to a centerline of the surface of rotation that defines the central inclined reflector surface.

10. The apparatus of claim 1 where the second focus is defined at or near an end of an optic fiber.

11. The apparatus of claim 1 where a demarcation point is defined between the forward solid angle of energy from the LED light source and the peripheral forward solid angle of the LED light source at that point on the primary reflector where the reflected energy is blocked by the LED light source with substantially all the energy from the demarcation point to the optical axis of the LED light source being collected by the center inclined reflector surface.

12. The apparatus of claim 1 further comprising means for providing in combination with the LED light source, thermal management element, primary reflector, central inclined reflector surface and angled mirror surface, one of the group including a flashlight, head torch, automotive headlight, bicycle light, aircraft lighting, marine lighting, theater and stage lighting, general area lighting, fiber optic system, reading light, medical lighting, dental lighting or overhead task light.

13. A method comprising:

generating light from an LED light source;

reflecting light from the LED light source by a primary reflector with at least one reflective surface oriented to collect light from the LED light source and direct collected light into a first reflected beam;

reflecting light from the LED light source by at least one central inclined reflector surface to at least one corresponding peripherally positioned angled mirror surface; and reflecting light from the angled mirror surface into a second reflected beam, where reflecting light from the LED light source by a primary reflector comprises reflecting light from the LED light source, which is disposed at or near a first focus of a first elliptical surface of the primary reflector, and which light is reflected by the first elliptical surface of the primary reflector, where reflecting light from the LED light source by at least one central inclined reflector surface comprises reflecting light by at least two second elliptical surfaces of two corresponding central inclined reflector surfaces to at least two corresponding angled mirror surfaces, and where reflecting light from the angled mirror surface into a second reflected beam comprises reflecting light from the angled mirror surface to a second focus of the first elliptical surface of the primary reflector.

14. The method of claim 13 further combining the first and second reflected beams Ito a composite beam.

15. The method of claim 14 where combining the first and second reflected beams comprises combining the first and second reflected beams as approximately parallel beams.

16. The method of claim 14 where generating light from an LED light source comprises radiating energy in a central solid angle, which energy would have been at least partially blocked by the LED light source when reflected by the primary reflector, but for being included in the second reflected beam of the composite beam.

17. The method of claim 13 where the primary reflector has an upper peripheral edge, where the angled mirror surface is disposed at or near the upper peripheral edge of the primary reflector and where reflecting light from the one central inclined reflector surface to at least one corresponding angled mirror surface comprises collecting and redirecting the energy from the central inclined reflector surface into a forward beam which is unobstructed by the LED light source.

18. The method of claim 13 where generating light from an LED light source comprising rearwardly radiating energy in a peripheral forward solid angle from the LED light source into the primary reflector, and where reflecting light from the LED light source from a primary reflector comprises forwardly reflecting the energy in a peripheral forward solid angle into a reflected beam approximately along a centerline or optical axis of the primary reflector.

19. The method of claim 13 where reflecting light from the one central inclined reflector surface comprises reflecting light in a first reflected ray which is parallel to a centerline of the surface of rotation that defines the central inclined reflector surface and where reflecting light from the angled mirror surface into the second reflected beam comprises redirecting the light collected from the central inclined reflector surface into a forward beam.

20. The method of claim 13 where reflecting light from the LED light source by the first elliptical surface of the primary reflector comprises redirecting light to an end of an optic fiber, and where reflecting light from the angled mirror surface to a second focus of the first elliptical surface of the primary reflector comprises redirecting light to the end of the optic fiber.

21. The method of claim 13 where a demarcation point is defined between a forward solid angle of energy from the LED light source and the peripheral forward solid angle of the LED light source at that point on the primary reflector where the reflected energy is blocked by the LED light source where reflecting light from the LED light source by at least one central inclined reflector surface comprises collecting substantially all the energy from the demarcation point to the optical axis of the LED light source.

* * * * *

UNITED STATES PATENT AND TRADEMARK OFFICE

CERTIFICATE OF CORRECTION

PATENT NO. : 7,850,345 B2
APPLICATION NO. : 12/063234
DATED : December 14, 2010
INVENTOR(S) : Ronald G. Holder et al.

It is certified that error appears in the above-identified patent and that said Letters Patent is hereby corrected as shown below:

Claim 1, column 8, line 51, "central reflector surface has a second surface, and where" is changed to -- central reflector surface has a second elliptical surface, and where --.

Signed and Sealed this
Twenty-second Day of March, 2011

David J. Kappos

David J. Kappos
*Director of the United States Patent and Trademark Office*